US009992576B2

(12) United States Patent
Bae et al.

(10) Patent No.: US 9,992,576 B2
(45) Date of Patent: Jun. 5, 2018

(54) SPEAKER INCLUDING DAMPER HAVING DEFORMATION PREVENTION MEMBER

(71) Applicant: SAMSUNG ELECTRONICS CO., LTD., Suwon-si (KR)

(72) Inventors: Won Youl Bae, Gwacheon-si (KR); Tae Myun Kim, Suwon-si (KR); Jong In Jo, Suwon-si (KR)

(73) Assignee: SAMSUNG ELECTRONICS CO. LTD, Suwon-si (KR)

( * ) Notice: Subject to any disclaimer, the term of this patent is extended or adjusted under 35 U.S.C. 154(b) by 0 days. days.

(21) Appl. No.: 14/820,663

(22) Filed: Aug. 7, 2015

(65) Prior Publication Data

US 2016/0100254 A1 Apr. 7, 2016

(30) Foreign Application Priority Data

Oct. 7, 2014 (KR) ..... 10-2014-0134816

(51) Int. Cl.
*H04R 25/00* (2006.01)
*H04R 7/26* (2006.01)
(Continued)

(52) U.S. Cl.
CPC ..... *H04R 7/26* (2013.01); *H04R 9/043* (2013.01); *H04R 9/06* (2013.01)

(58) Field of Classification Search
CPC ..... H04R 9/043; H04R 9/045; H04R 1/06; H04R 31/003; H04R 2231/003;
(Continued)

(56) References Cited

U.S. PATENT DOCUMENTS 7,840,025 B2 * 11/2010 Ikeda ..... H04R 9/04 381/403
9,025,808 B2 * 5/2015 Kwon ..... H04R 9/043 381/398
(Continued)

FOREIGN PATENT DOCUMENTS

EP 1748675 A1 1/2007
EP 2472906 A1 7/2012
(Continued)

OTHER PUBLICATIONS

Communication dated Feb. 19, 2016, issued by the European Patent Office in counterpart European Application No. 15188804.7.
(Continued)

*Primary Examiner* — Davetta W Goins
*Assistant Examiner* — Phylesha Dabney
(74) *Attorney, Agent, or Firm* — Sughrue Mion, PLLC

(57) ABSTRACT

A speaker includes: a diaphragm; and a damper configured to adjust vibration of the diaphragm and including a first and second metal plates having polarities that are different from each other and symmetrical with each other, wherein the damper further includes first and second deformation prevention members disposed on bottom surfaces of the first and second metal plates, respectively, and wherein first and second deformation prevention members protrude downward and extend along a major-axis direction of the diaphragm, and the first and second deformation members are configured to prevent deformation of diaphragm caused by a vertical load.

27 Claims, 18 Drawing Sheets

(51) Int. Cl.
*H04R 9/06* (2006.01)
*H04R 9/04* (2006.01)

(58) Field of Classification Search
CPC ..... H04R 2307/201; H04R 2307/207; H04R 7/14; H01R 4/4809
USPC ..... 381/162, 166, 407, 412, 420, 423, 398, 381/431, 404; 181/157, 166
See application file for complete search history.

(56) References Cited

U.S. PATENT DOCUMENTS

| | | | | |
|---|---|---|---|---|
| 2004/0022407 | A1 | 2/2004 | Steere et al. | |
| 2012/0106775 | A1 | 5/2012 | Shao et al. | |
| 2013/0133975 | A1* | 5/2013 | Kim | H04R 7/16 181/166 |
| 2013/0161122 | A1* | 6/2013 | Kim | G10K 13/00 181/157 |
| 2014/0119578 | A1* | 5/2014 | Choi | H04R 9/045 381/162 |
| 2014/0241566 | A1* | 8/2014 | Choi | H04R 9/04 381/400 |
| 2016/0100254 | A1* | 4/2016 | Bae | H04R 9/043 381/354 |

FOREIGN PATENT DOCUMENTS

| | | | | | |
|---|---|---|---|---|---|
| JP | 2003-32789 | A | | 1/2003 | |
| JP | 2007533230 | A | | 11/2007 | |
| JP | 2009-60571 | A | | 3/2009 | |
| KR | 1020000026029 | A | | 5/2000 | |
| KR | 20010074129 | A | * | 8/2001 | H04R 9/02 |
| KR | 1020070001228 | A | | 1/2007 | |
| KR | 10-2011-0107648 | A | | 10/2011 | |
| KR | 10-1154253 | B1 | | 6/2012 | |
| KR | 1020120079306 | A | | 7/2012 | |
| WO | 2006035412 | A1 | | 4/2006 | |
| WO | WO 2012086931 | A1 | * | 6/2012 | H04R 9/047 |

OTHER PUBLICATIONS

International Search Report dated Nov. 12, 2015, issued by International Searching Authority in counterpart International Patent Application No. PCT/KR2015/007945.
Communication dated Jan. 31, 2017 issued by the European Patent Office in counterpart European Patent Application No. 15188804.7.
Communication dated Nov. 27, 2017 issued by the European Patent Office in counterpart European Patent Application No. 15188804.7.

* cited by examiner

SPEAKER INCLUDING DAMPER HAVING DEFORMATION PREVENTION MEMBER

CROSS-REFERENCE TO RELATED APPLICATION

This application claims priority from Korean Patent Application No. 10-2014-0134816, filed on Oct. 7, 2014 in the Korean Intellectual Property Office, the disclosure of which is incorporated herein by reference in its entirety.

BACKGROUND

1. Field

Apparatuses consistent with exemplary embodiments relate to a slim speaker, and more particularly, to a speaker that is capable of reinforcing strength.

2. Description of the Related Art

Speakers are sound output devices in which electrical signals output from an audio amplifier are converted into vibration of a vibration unit, waves of compression and rarefaction are generated in air, and sound waves are created. Speakers are classified into different types of speakers, such as magnetic speakers, dynamic speakers, condenser speakers, piezoelectric speakers, and ceramic speakers, according to their operating principles.

In the related art, a speaker includes a magnetic circuit unit including a magnet for generating magnetic flux, a yoke portion for providing a route of the magnetic flux, and a bobbin around which a voice coil is wound, a frame, and a vibrometer including a diaphragm that vibrates according to movement of the bobbin, a damper for adjusting a vibration direction of the diaphragm, and edges for fixing outer edges of the diaphragm to the frame.

In the above-described speaker, when a current is applied to the voice coil, the magnetized voice coil interacts with the magnetic flux generated in the magnets and move in a forward/back direction (i.e., between the diaphragm provided at a forward portion and the magnet provided at a back portion). Thus, the diaphragm vibrates, and sound pressure is generated.

In generating the sound pressure, vertical vibration and complicated vibration are mixed in movement of the speaker.

In order to support the movement of the speaker, the shape of the diaphragm should be structurally reinforced, or a support structure should be added to upper and lower portions of the diaphragm.

Recently, as electronic devices become thinner and slimmer, the speaker needs to be thinner and slimmer accordingly. Thus, oval or rectangular speakers have been developed and used.

In the oval or rectangular speaker, a portion of the speaking extending along a long-axis direction of diaphragm is vulnerable to bending strength due to the structure of the oval or rectangular speaker. This disadvantage causes offset interference according to positions of sound pressure scattered in the speaker so that instability can be generated in a medium or high band.

SUMMARY

One or more exemplary embodiments provide a speaker in which sound quality can be improved by preventing a structural deformation.

One or more exemplary embodiments also provide a speaker having a damper that is capable of supporting vertical movement and simultaneously reinforcing rigidity of a diaphragm.

In accordance with an aspect of an exemplary embodiment, there is provided a speaker comprising: a diaphragm; and a damper configured to adjust vibration of the diaphragm and comprising a first and second metal plates having polarities that are different from each other and being symmetrical with each other, wherein the damper further includes first and second deformation prevention members disposed on bottom surfaces of the first and second metal plates, respectively, and wherein the first and second deformation prevention members protrude downward and extend along a major-axis direction of the diaphragm, and are configured to prevent deformation of the diaphragm caused by a vertical load.

The first and second deformation prevention members may be bent downward from inner edges of the first and second metal plates, respectively.

Each of the first and second deformation prevention members may include at least one straight panel disposed to be parallel to each other along the major-axis direction.

Each of the first and second deformation prevention members may further include a curved panel connected to the at least one straight panel.

Each of the first and second deformation prevention members may include: a plurality of straight panels; and a curved panel, wherein the plurality of straight panels are disposed to be parallel to each other along the major-axis direction.

Each of the first and second deformation prevention members may include at least one protrusion which extends outward from opposite edges of a corresponding one of the first and second metal plates, and wherein the at least one protrusion includes: a plurality of protrusion surfaces which extend in a horizontal direction with respect to the first and second metal plates; and a plurality of protrusion pieces, each of plurality of protrusion pieces bent from a respective protrusion surface of the plurality of protrusion surfaces in a vertical direction with respect to the first and second metal plates.

The plurality of protrusion surfaces may be disposed to be spaced apart from one another at a regular interval, and wherein the plurality of protrusion pieces are disposed to be spaced apart from one another at the regular interval.

The plurality of protrusion surfaces may be disposed to be spaced apart from one another at an irregular interval, wherein the plurality of protrusion pieces are disposed to be spaced apart from each other at the irregular interval.

Each of the first and second deformation prevention members may include: a contact surface which comes into contact with the bottom surface of a corresponding one of the first and second metal plates; and a bending portion bent downward from the contact surface.

The bending portion may be formed in a panel shape.

At least a part of the bending portion may include a curved panel.

The damper may be formed integrally with the diaphragm.

The damper may be configured to prevent deformation of the diaphragm due to a vertical load in a center portion of the diaphragm along the major axis direction.

In accordance with an aspect of another exemplary embodiment, there is provided a speaker including: an oval-shaped diaphragm having a major axis and a minor axis; and a damper configured to adjust vibration of the diaphragm and having a first and second inner surfaces, wherein the damper includes first and second deformation prevention members protruding from each of the first and second inner surfaces, respectively, in a direction perpendicular to a direction of the major-axis and extending in the direction of the major axis, and the first and second deformation members are configured to prevent deformation in the major-axis direction of the diaphragm.

Each of the first and second deformation prevention members may include a plurality of panels disposed to be parallel to one another in the major-axis direction.

Each of the first and second deformation prevention members may include a curved panel protruding from the plurality of panels.

Each of the first and second deformation prevention members may include a plurality of protrusions, each of the plurality of protrusions having at least one separation portion.

Each of the plurality of protrusions may include: a protrusion surface which extends in a horizontal direction with respect to the damper; and a protrusion piece bent from the protrusion surface in a vertical direction with respect to the damper.

The at least one separation portion may be provided at a uniform interval from one another.

The at least one separation portion may be provided at a non-uniform interval from one another.

The damper may have a plate shape, be made with a metal material and includes: a first damper; and a second damper having a different polarity from the first damper, wherein the first damper and the second damper are symmetrical with each other.

The first and second deformation prevention members may be disposed in corresponding positions of the first damper and the second damper, respectively, to be parallel to each other.

The first and second deformation prevention members may be bent downward from an inner end of each of the first damper and the second damper, respectively, and are integrally formed with each of the first and second dampers, respectively.

In accordance with an aspect of yet another exemplary embodiment, there is provided a speaker including: a rectangular frame having a long axis and a short axis; a magnetic circuit unit coupled to the frame and configured to generate a magnetic force; a voice coil provided in the frame to vibrate due to the magnetic force; a diaphragm configured to vibrate and produce sound due to vibration of the voice coil; and a damper having a plate shape, provided between the diaphragm and the voice coil and configured to adjust vibration of the diaphragm, wherein the damper includes: a first damper; a second damper having a different polarity from the first damper; and a first and second deformation prevention members provided in the first damper and the second damper, respectively, the first and second deformation prevention members extending along a long-axis direction of the diaphragm and being configured to prevent a deformation of the diaphragm caused by a vertical load.

The first and second deformation prevention members may be bent from an inner edge of the first damper and the second damper, respectively, and wherein the first and second deformation prevention members may be integrally formed with the first and the second dampers, respectively.

Each of the first and second deformation prevention members may include at least one straight panel and is disposed in a corresponding position of each of the first damper and the second damper, respectively, to be parallel to each other.

Each of the first and second deformation prevention members may include a curved panel.

Each of the first and second deformation prevention members may include a plurality of protrusions, each of the plurality of protrusions having at least one separation portion.

Each of the plurality of protrusions may include: a protrusion surface which extends in a horizontal direction with respect to the damper; and a protrusion piece bent from the protrusion surface in a vertical direction with respect to the damper.

In accordance with an aspect of yet another exemplary embodiment, there is provided a vibration unit of a speaker including: a diaphragm configured to produced sound; and a damper provided under the diaphragm to support the diaphragm and configured to adjust vibration of the diaphragm, wherein the damper includes: a first and second connection fixtures extending along a major axis of the diaphragm and extending on a surface including the major axis and a minor axis; and a first and second deformation prevention members protruding from the first and second connection fixtures, respectively, in a direction intersecting the major and minor axes, and wherein the first and second deformation prevention members extend along the major axis of the diaphragm.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Hereinafter, exemplary embodiments of the disclosure will be described in detail with reference to the accompanying drawings.

Figure 1:
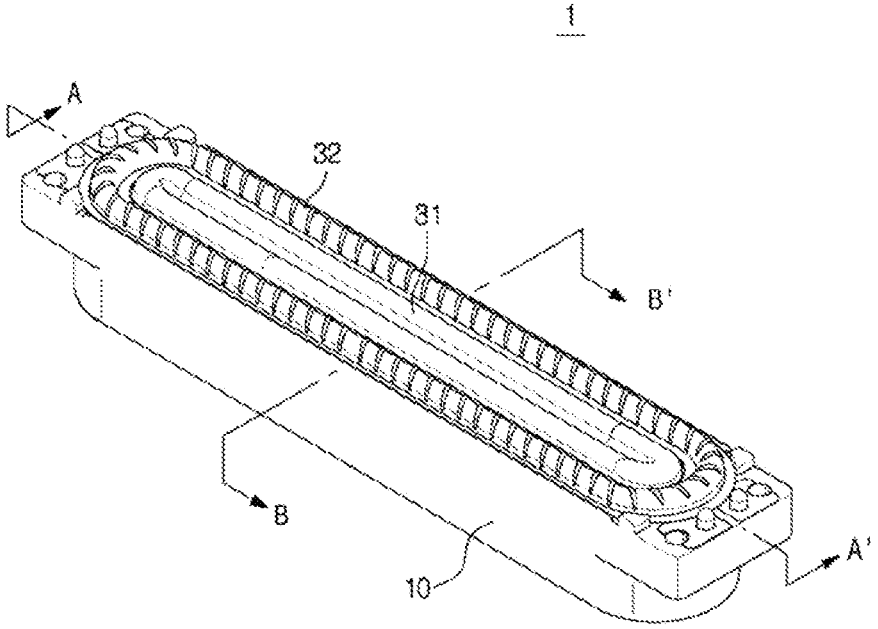
FIG. 1 is a perspective view of a speaker according to an exemplary embodiment.
Figure 2:
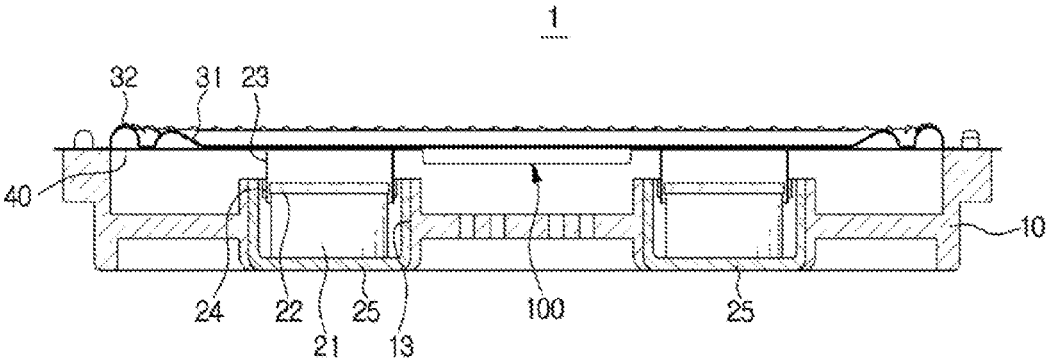
FIG. 2 is a cross-sectional view taken along line A-A' of FIG. 1.
Figure 3:
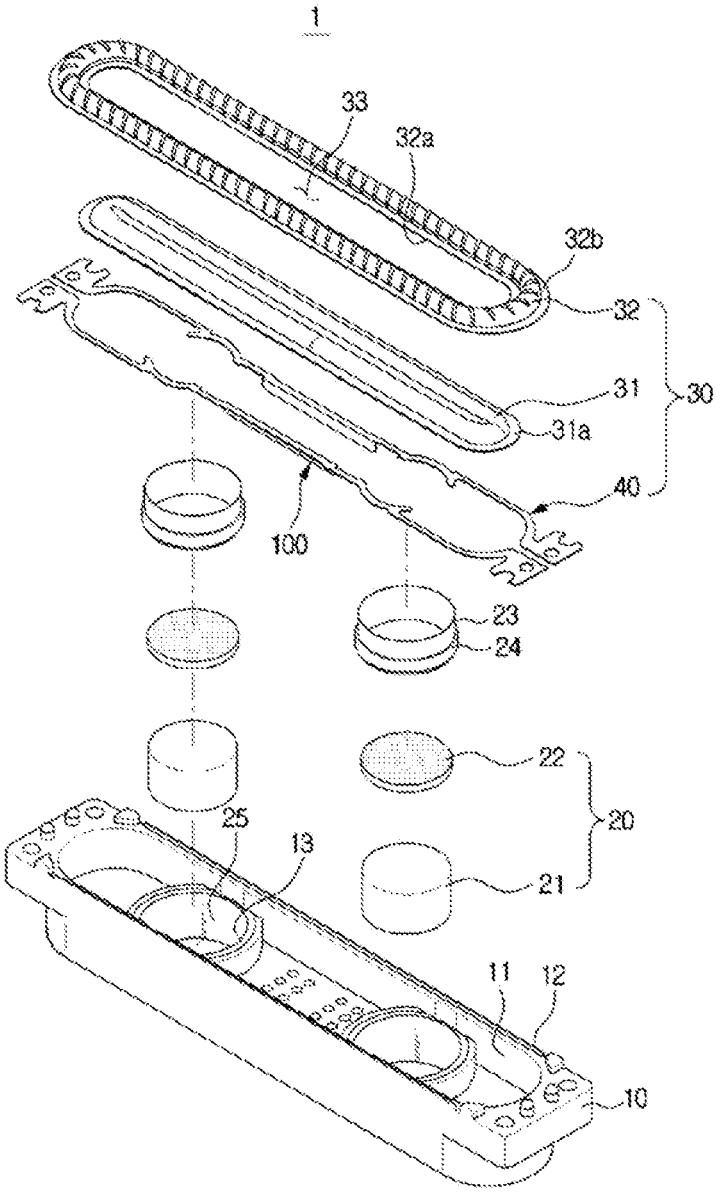
FIG. 3 is an exploded perspective view of the speaker according to an exemplary embodiment.

FIG. 1 is a perspective view of a speaker 1 according to an exemplary embodiment. FIG. 2 is a cross-sectional view of the speaker 1 taken along line A-A' of FIG. 1. FIG. 3 is an exploded perspective view of the speaker 1 according to an exemplary embodiment.

As illustrated in FIGS. 1 through 3, a speaker 1 includes a frame 10 formed in a hollow shape, a magnetic circuit unit 20 disposed in the frame 10, and a vibration unit 30 disposed to vibrate due to the magnetic circuit unit 20.

The frame 10 constitutes an exterior of the speaker 1 and has a rectangular shape in a plan view in which an appearance of the frame 10 has a long axis and a short axis. An oval through-hole 11 is formed at the center of the frame 10, and a plurality of grooves 13 are formed inside a lower portion of the frame 10 so as to be spaced a predetermined distance apart from one another. The exemplary embodiment shows the frame 10 having two (2) grooves formed inside the lower portion of the frame 10. However, the exemplary embodiment is not limited thereto. The frame 10 also includes a coupling portion 12, to which an edge 32 of the vibration unit 30 is coupled, is formed at an edge of a top surface of the frame 10. The coupling portion 12 will be described in more detail below.

Hereinafter, when describing sides and directions of components of the speaker 1 including the frame 10, a side and a direction, which are directed toward a top side of the frame 10 as shown in FIGS. 1-3, are referred to as a 'top side or a upper side', and a side and a direction, which are directed toward a bottom side of the frame 10, are referred to as a 'bottom side or a lower side' as shown in FIGS. 1-3.

The magnetic circuit unit 20 may be disposed inside the through-hole 11 at the lower side of the frame 10, and the vibration unit 30 may be disposed on a top surface of the frame 10. The magnetic circuit unit 20 and the vibration unit 30, in combination, may generate an electrical force, vibrate and generate sound.

Electrical signals are transmitted to the magnetic circuit unit 20 so as to generate sound in the speaker 1. The magnetic circuit unit 20 may include a magnet 21, a plate 22 disposed on the magnet 21, and a yoke 25.

The yoke 25 may be inserted into the plurality of grooves 13 of the frame 10, and a damper 40 and the edge 32 of the vibration unit 30 are sequentially stacked on the grooves 13 as shown in FIGS. 2 and 3.

The yoke 25 having an upper portion in an open ring shape is seated in a corresponding groove 13, and accommodates the magnet 21.

The magnet 21 has a cylindrical cross-sectional shape so as to be installed in the yoke 25 and is coupled to a bottom surface of the plate 22.

The plate 22 is attached to a top surface of the magnet 21 and is disposed to accumulate magnetic forces of the magnet 21 in a vertical direction.

The magnet 21 generates magnetic forces, e.g., an attractive force and a repulsive force, to correspond to a magnetic field generated in a voice coil 24 so that the voice coil 24 may vibrate in the vertical direction between the top and bottom sides of the speaker 1.

In the exemplary embodiment, the magnet 21 may include neodymium (Nd), ferrite, or other permanent magnet materials. However, the exemplary embodiment is not limited thereto.

In the exemplary embodiment, each of the plate 22, the magnet 21, and the yoke 25 that constitute the magnetic circuit unit 20, has a cylindrical shape. However, exemplary embodiment is not limited thereto. For example, each of the plate 22, the magnet 21, and the yoke 25 may also be formed in a rectangular or an oval cross-sectional shape, or a ring shape so as to correspond to the shape of the frame 10 or the oval through-hole 11, for example.

The vibration unit 30 may include the voice coil 24 disposed to vibrate while being linked to the magnetic circuit unit 20, a bobbin 23 around which the voice coil 24 is wound, a diaphragm 31 that reproduces sound while vibrating due to the voice coil 24, the edge 32 disposed to connect the diaphragm 31 and the frame 10 to each other, and the damper 40 disposed to guide a movement direction of the voice coil 24 toward the vertical direction and to confine left/right movement.

The damper 40 may be disposed at an upper portion of an inside of the frame 10 and may support the diaphragm 31 and the voice coil 24 so that vertical vibration may be precisely performed.

The edges 32 are mounted on the coupling portion 12 of the frame 10. The edges 32 may have a rectangular or oval cross-sectional shape so as to correspond to the shape of the diaphragm 31.

The edge 32 may be formed in a ring shape in which a hollow portion 33 is formed in the center of the edge 32. The edge 32 includes an inner contact surface 32*a* formed to extend from an inner circumferential surface of the edge 32 and an outer contact surface 32*b* formed to extend from an outer circumferential surface of the edge 32.

The inner contact surface 32*a* of the edge 32 may come into contact with an outer edge of the diaphragm 31, and the outer contact surface 32*b* of the edge 32 may be coupled to the coupling portion 12 of the frame 10.

Thus, the edge 32 may be disposed between the frame 10 and the diaphragm 31 so as to fix the diaphragm 31 to the frame 10 and simultaneously to control vibration of the diaphragm 31.

The diaphragm 31 transmits sound to the outside by producing sound according to vibration of the voice coil 24.

The diaphragm 31 may have a rectangular or oval cross-sectional shape and may be disposed to cover an opened upper portion of the frame 10.

An outer circumferential surface of the diaphragm 31 is supported while coming into contact with the damper 40, and an inner circumferential surface of the diaphragm 31 is disposed to be coupled to an outer circumferential surface of an upper side of the bobbin 23.

A support surface 31*a* may be disposed at an outer edge of the diaphragm 31 so as to extend from the diaphragm 31 to be coupled to the inner contact surface 32*a* of the edge 32.

The voice coil 24 is disposed below the damper 40 and to surround exterior of upper portions of the plate 22 and the magnet 21 as shown in FIG. 2. The voice coil is disposed to be wound around the bobbin 23 having a cylindrical shape, becomes an electromagnet due to the supply of electrical power, forms a magnetic field and generates a vertical vibration force in response to an interaction with the magnet 21.

Thus, the voice coil 24 is magnetized when a current is applied and interacts with magnetic flux generated in the magnet 21 to move vertically. The diaphragm 31 produces sound while vibrating in the vertical direction due to the movement of the voice coil 24.

The damper 40 may be formed in a metal material and may have a thin plate shape. The damper may be formed with a pair of metal plates being symmetrical with each other and to be spaced apart from each other.

The damper 40 is provided as a metal thin plate, such as a copper plate, and is configured in such a way that a first metal plate 41 and a second metal plate 42 may be symmetrical with each other. Each of the first and second metal plates 41 and 42 may conduct positive (+) or negative (−) electrical signal, respectively.

The first metal plate 41 and the second metal plate 42 may be installed to be spaced apart from each other.

The damper 40 is formed in a shape corresponding to the shape of the frame 10 so as to be coupled to an upper portion of the frame 10.

The rectangular or oval speaker 1 may be formed so that a portion of the speaker 1 extending in a major axis direction of the rectangular or oval speaker 1 may be easily deformed due to the elongated structure speaker 1 along the major axis. Thus, the speaker 1 according to the exemplary embodiment may include deformation prevention members 100 so as to prevent a deformation of the portion extending in the major-axis direction of the speaker 1.

Figure 4:
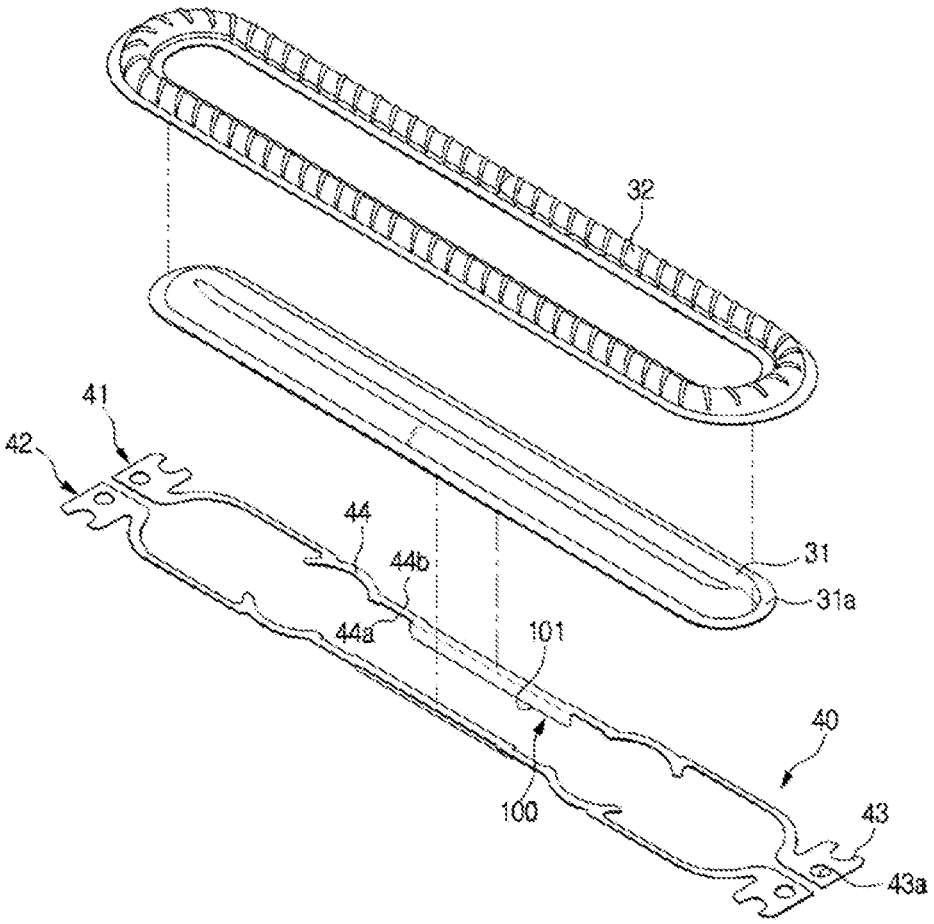
FIG. 4 is a perspective view of a damper of the speaker according to an exemplary embodiment.
Figure 5:
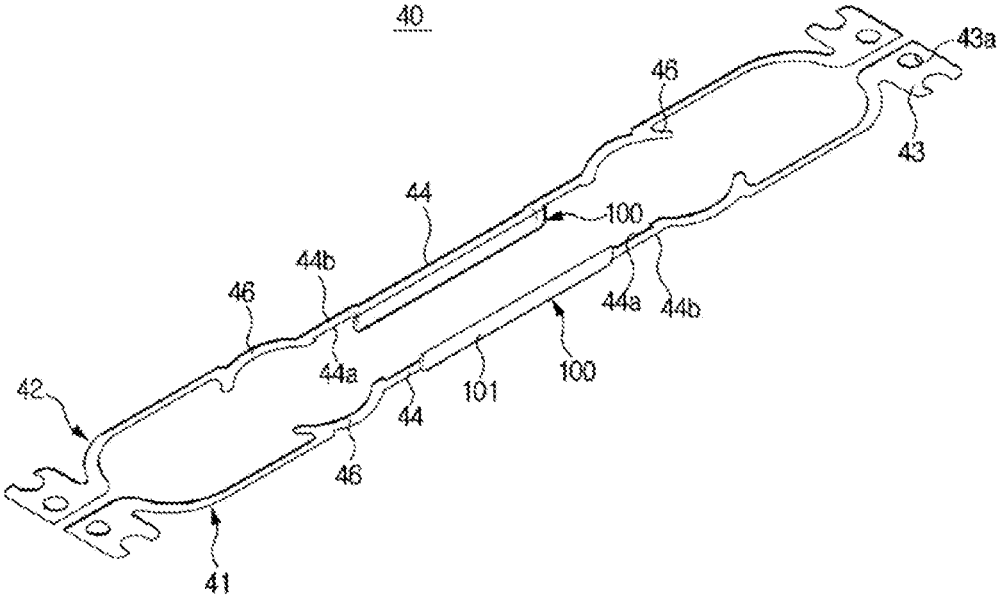
FIG. 5 is a perspective view of deformation prevention members of the damper according to an exemplary embodiment.
Figure 6:
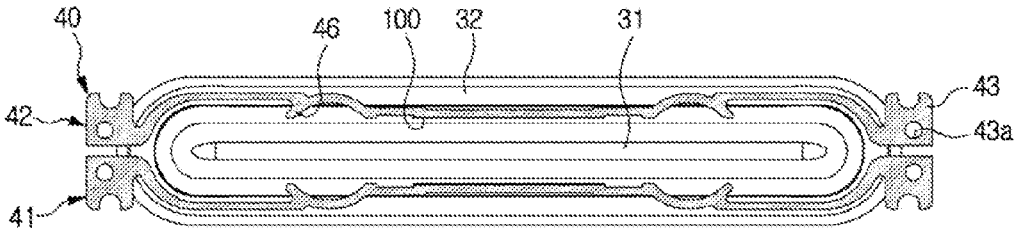
FIG. 6 is a schematic view illustrating a mounting state of the damper according to an exemplary embodiment.
Figure 7:
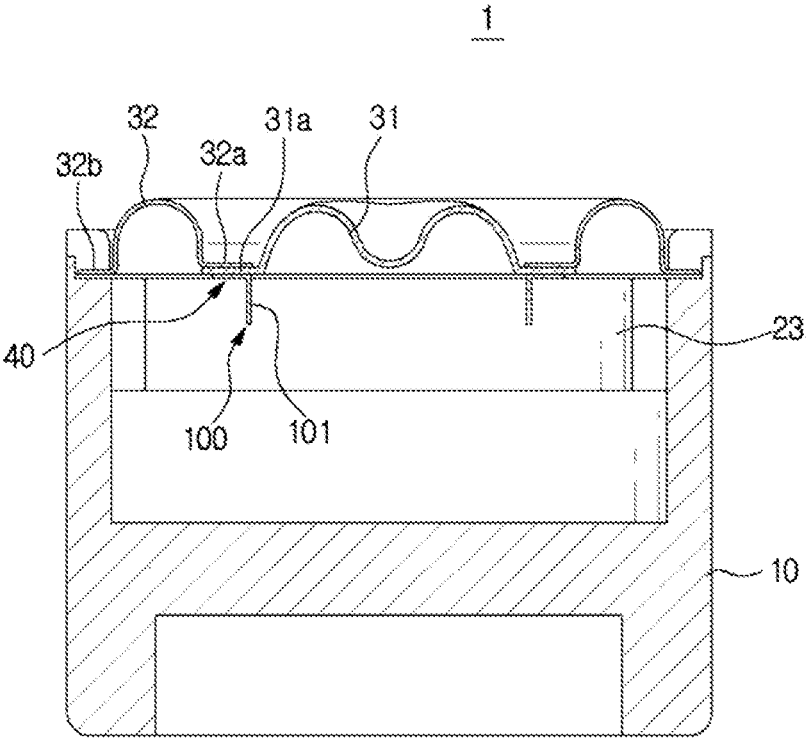
FIG. 7 is a cross-sectional view taken along line B-B' of FIG. 1.
Figure 8:
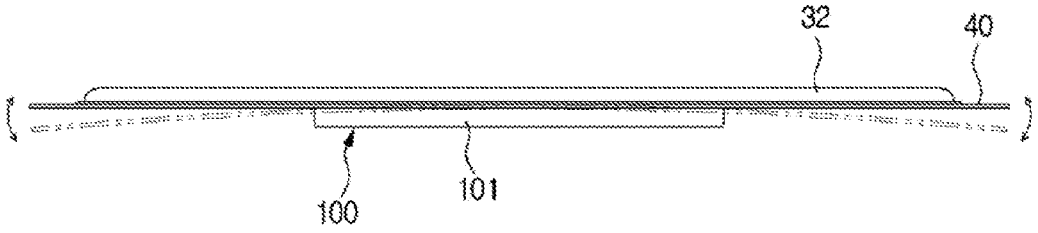
FIG. 8 is a schematic view illustrating an operating state of the deformation prevention members of the damper according to an exemplary embodiment.

FIG. 4 is a perspective view of a damper 40 of a speaker 1 according to an exemplary embodiment. FIG. 5 is a perspective view of a deformation prevention member 100 of the damper 40 according to an exemplary embodiment. FIG. 6 is a schematic view illustrating a mounting state of the damper 40 according to an exemplary embodiment. FIG. 7 is a cross-sectional view taken along line B-B' of FIG. 1. FIG. 8 is a schematic view illustrating an operating state of the deformation prevention member 100 of the damper 40 according to an exemplary embodiment.

As illustrated in FIGS. 4 through 8, the deformation prevention member 100 is disposed in the damper 40 of the speaker 1.

The deformation prevention member 100 is integrally formed in the center portion of the damper 40 and is disposed to support the portion extending in the major-axis direction (i.e., the long axis direction) and to structurally reinforce strength of the damper 40.

The damper 40 formed of a metal thin plate includes a pair of the first metal plate 41 and the second metal plate 42 disposed to be symmetrical with each other.

The first metal plate 41 and the second metal plate 42 are installed inside an upper side of the frame 10 and are formed in the same shape so as to be symmetrical with each other.

Each of the first metal plate 41 and the second metal plate 42 includes terminals 43 disposed at opposite ends of each of the first metal plate 41 and the second metal plate 42 along the major-axis direction and includes connection support fixtures 44 that connect the terminals 43 provide at both ends along the major-axis direction.

The connection support fixtures 44 may be formed so that the bottom surface of the diaphragm 31 and the top surface of the voice coil 24 may be supported.

Each of the connection support fixtures 44 extends from an inner end 44*a* of each of the first and second metal plates 41 and 42, and voice coil installation ports 46 each having a curve shape are disposed in the connection support fixtures 44 so as to guide the voice coil 24 to pass through the voice coil installation ports 46.

The voice coil installation ports 46 are formed to be spaced apart from each other from the center of the connection support fixtures 44 toward both sides of the connection support fixtures 44. In the present embodiment, the voice coil installation ports 46 are formed in circular shapes. However, the exemplary embodiment is not limited thereto. Each of the voice coil installation ports of the damper may be formed to have a shape corresponding to the shape of voice coil 24.

The terminals 43 are formed to be exposed to edge portions of the frame 10 so that an external power supply (not shown) may be connected to the terminals 43. A screw (not shown) may pass through a through-hole 43*a* of each of the terminals 43 so that a connection member (not shown) to which the external power is supplied, may be fastened to the frame 10 while being engaged with the terminals 43.

The deformation prevention member 100 is disposed in the connection support fixture 44. The deformation prevention member 100 is bent from the inner end 44*a* of the connection support fixture 44 downward and is integrally formed with the connection support fixture 44.

The deformation prevention member 100 has a bar shape 101 extending in a straight line along the major-axis direction and is formed in the center of the connection support fixture 44 in a predetermined length.

Also, the length of the deformation prevention member 100 may vary according to the length and size of the damper 40.

Because the long/major axis of the speaker 1 having a noncircular shape is vulnerable to bending force, offset interference according to positions of sound pressure and instability in a medium or high band may occur.

However, if the deformation prevention member 100 is formed in the center of the connection support fixture 44 along the major-axis direction in this way of each of the first and second metal plates 41 and 42 of the damper 40, bending strength is reinforced, and occurrence frequencies of a vibration mode are increased so that the width of a stable reproduction band is increased.

The deformation prevention member 100 is formed in each of the first metal plate 41 and the second metal plate 42, respectively, so that the deformation prevention member 100 of the first metal plate 41 and the deformation prevention member 100 of the second metal plate 42 are disposed to be parallel to each other.

In this way, the deformation prevention members 100 disposed parallel to each other in the major-axis direction from the center of the damper 40 may stably support the diaphragm 31 and may reinforce strength along the major-axis direction from the center of the damper 40.

Thus, the voice coil 24 and the diaphragm 31 may smoothly vibrate without any deformation of the portion extending in the major-axis direction using the deformation prevention member 100.

Figure 9:
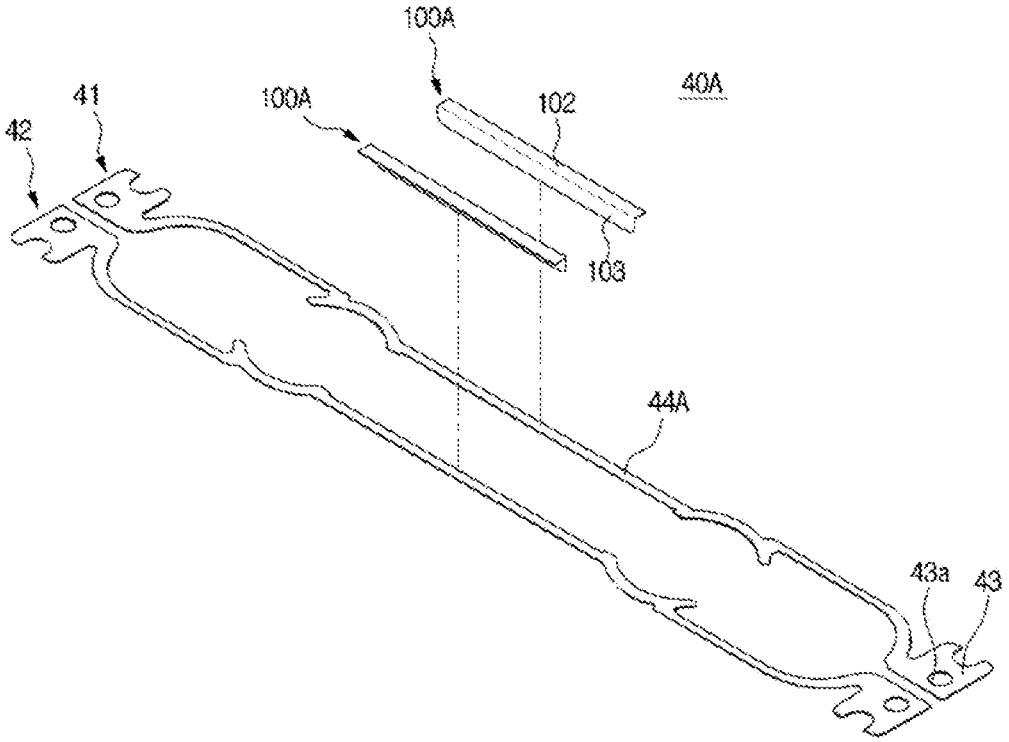
FIG. 9 is a perspective view of deformation prevention members according to an exemplary embodiment.

FIG. 9 is a perspective view of deformation prevention members 100A according to an exemplary embodiment. As illustrated in FIG. 9, deformation prevention members 100A according to an exemplary embodiment may be placed on a damper 40A.

Each of the deformation prevention members 100A includes a contact surface 102 disposed to come into contact with the damper 40A and a bending portion 103 bent from the contact surface 102.

The contact surface 102 is disposed to be fixed to a bottom surface of a connection support fixture 44A of the damper 40A. In the exemplary embodiment, the contact surface 102 is adhered to the damper 40A. However, the exemplary embodiment is not limited thereto. For example, a contact surface 102 may be fixed to a damper using a separate fixing member, such as a screw.

In the exemplary embodiment, a width of the contact surface 102 may be smaller than a width of the connection support fixture 44A. However, the exemplary embodiment is not limited thereto.

The bending portion 103 is bent from one end of the contact surface 102 and extends downward. The bending portion 103 may be formed in a straight bar shape/a straight panel shape.

In the exemplary embodiment, the bending portion 103 may be formed perpendicular to the contact surface 102.

Thus, the bending portion 103 may be formed to protrude along a major-axis direction of the speaker 1 downward and thus may reinforce strength of the damper 40A along the long-axis direction.

The deformation prevention member 100A is formed in each of the first metal plate 41 and the second metal plate 42 that constitute the damper 40A, respectively, and the deformation prevention members are disposed parallel to each other in the major-axis direction from the center of the damper 40A.

Thus, the damper 40A may stably support the diaphragm 31 and may reinforce the strength of the major-axis direction of the damper 40A using the deformation prevention members 100A so that smooth vibration may be performed without any deformation in the portion of the long-axis direction of the damper 40A.

Figure 10:
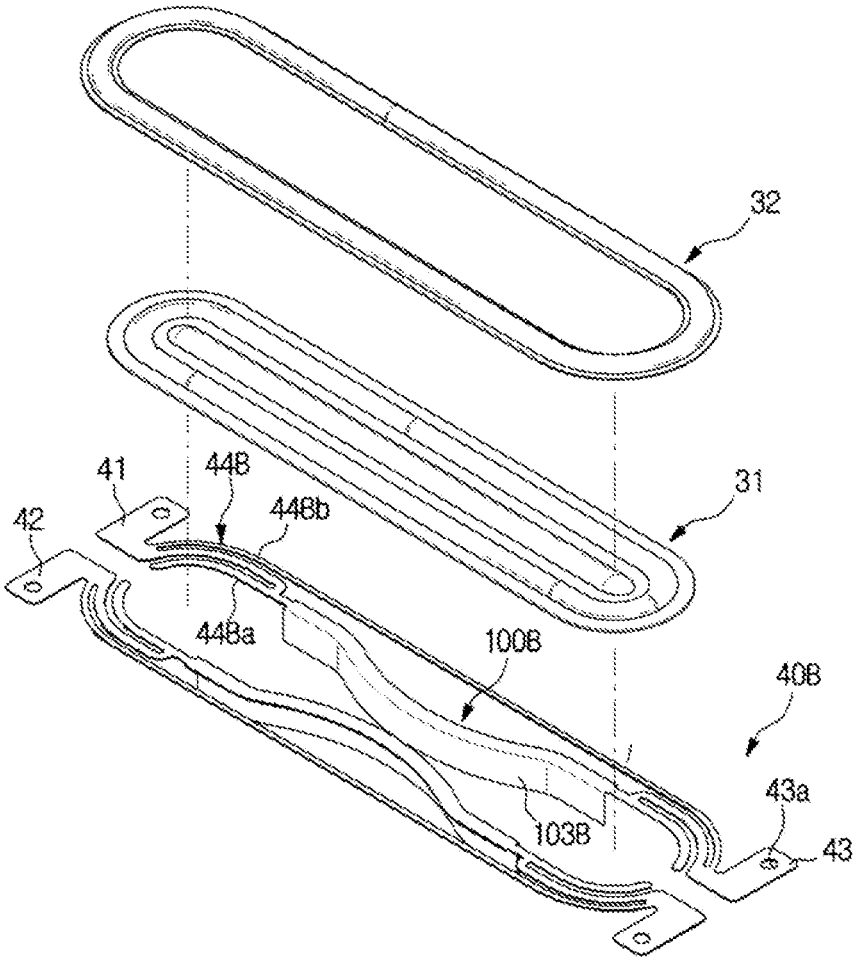
FIG. 10 is a perspective view of deformation prevention members according to an exemplary embodiment.
Figure 11:
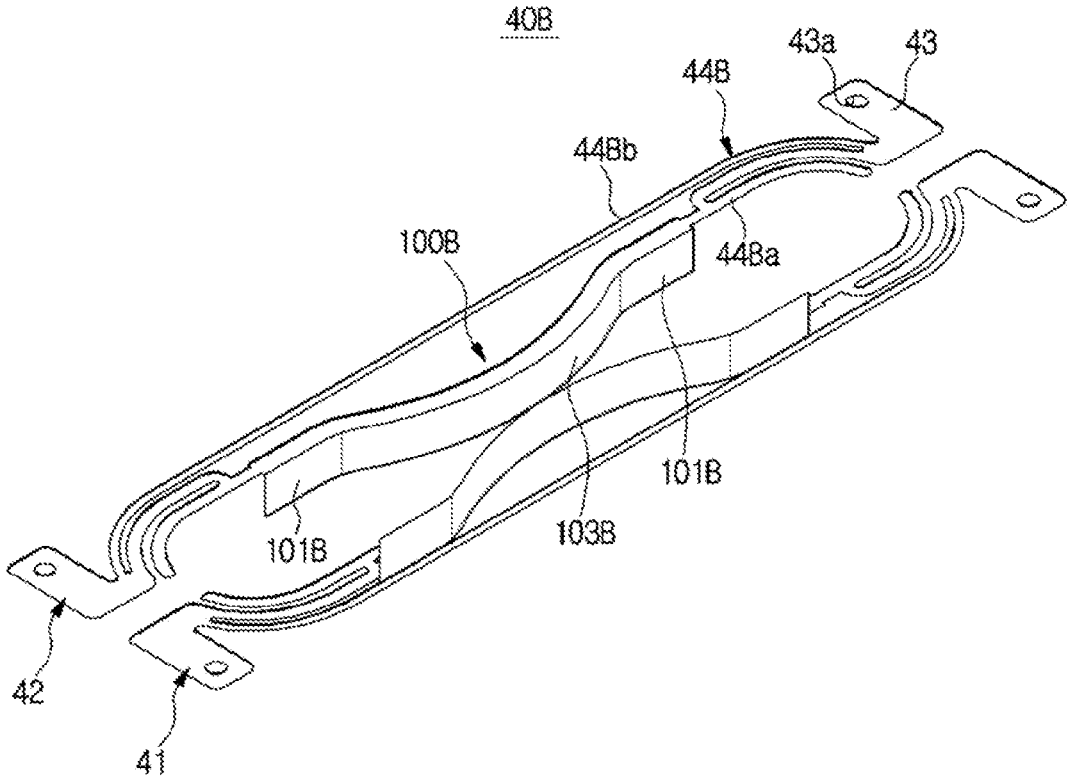
FIG. 11 is an enlarged perspective view of the deformation prevention members according to an exemplary embodiment.
Figure 12:
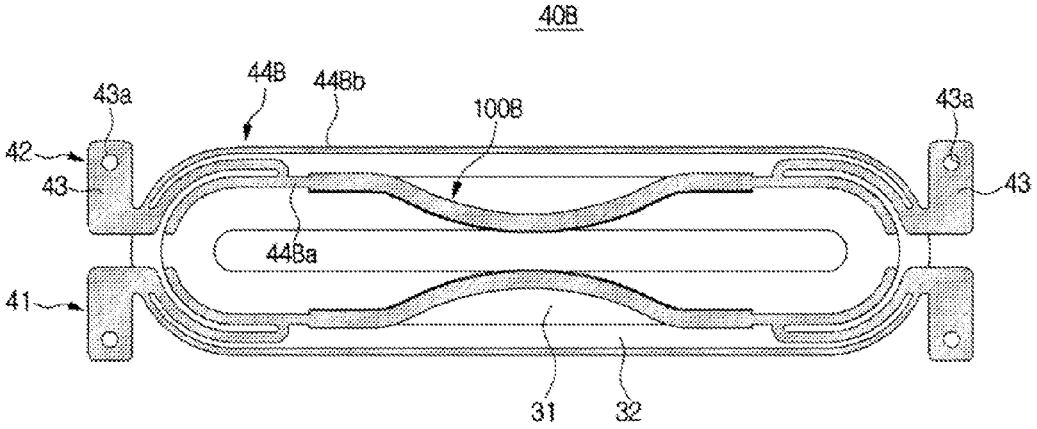
FIG. 12 is a view of coupling the deformation prevention members according to an exemplary embodiment and a diaphragm.

FIG. 10 is a perspective view of deformation prevention members 100B according to an exemplary embodiment. FIG. 11 is an enlarged perspective view of the deformation prevention members 100B according to an exemplary embodiment. FIG. 12 is a view of coupling the deformation prevention members 100B according to an exemplary embodiment and a diaphragm 31.

As illustrated in FIGS. 10 through 12, deformation prevention members 100B according to an exemplary embodiment are disposed in a damper 40B.

The deformation prevention members 100B may be integrally formed in the damper 40B.

The damper 40B includes a pair of metal plates 41 and 42 disposed to be symmetrical with each other.

Each of the first metal plate 41 and the second metal plate 42 includes terminals 43 disposed at both ends of the first metal plate 41 and the second metal plate 42 and a connection support fixture 44B that connects the terminals 43.

The connection support fixture 44B may include an inner support fixture 44Ba disposed to connect insides of the terminals 43 and an outer support fixture 44Bb disposed outside the inner support fixture 4BA so as to connect outsides of the terminals 43. In the exemplary embodiment, the connection support fixture 44B includes the inner support fixture 44Ba and the outer support fixture 44Bb. However, the exemplary embodiment is not limited thereto. A connection support fixture may also be formed as one connection support fixture, an inside and an outside of which are integrally formed.

Meanwhile, the deformation prevention members 100B may be integrally formed with the inner support fixture 44Ba of the connection support fixture 44B.

The deformation prevention members 100B may be formed to be bent from inner ends at the center portion of the inner support fixture 44Ba downward. In this case, the deformation prevention members 100B are formed to protrude along a major-axis direction of the deformation prevention member 100B.

Each of the deformation prevention members 100B may include straight panel portions 101B formed on both ends of each deformation prevention member 100B and curve portions 103B formed between the straight panel portions 101B.

The curve portions 103B are formed so that their centers may protrude from the damper 40B inward.

Thus, outer edges of the diaphragm 31 are supported by the connection support fixture 44B of the damper 40B, and the center of the diaphragm 31 is supported by the deformation prevention members 100B of the damper 40B formed in the long-axis direction of the diaphragm 31.

In the exemplary embodiment, the curve portions 103B of each deformation prevention member 100B stably support the center of the diaphragm 31 so that the strength of the major-axis direction and the center of the diaphragm 31 can be reinforced and thus smooth vibration can be performed without any deformation of the portion of the diaphragm 31 along the major-axis direction.

Figure 13:
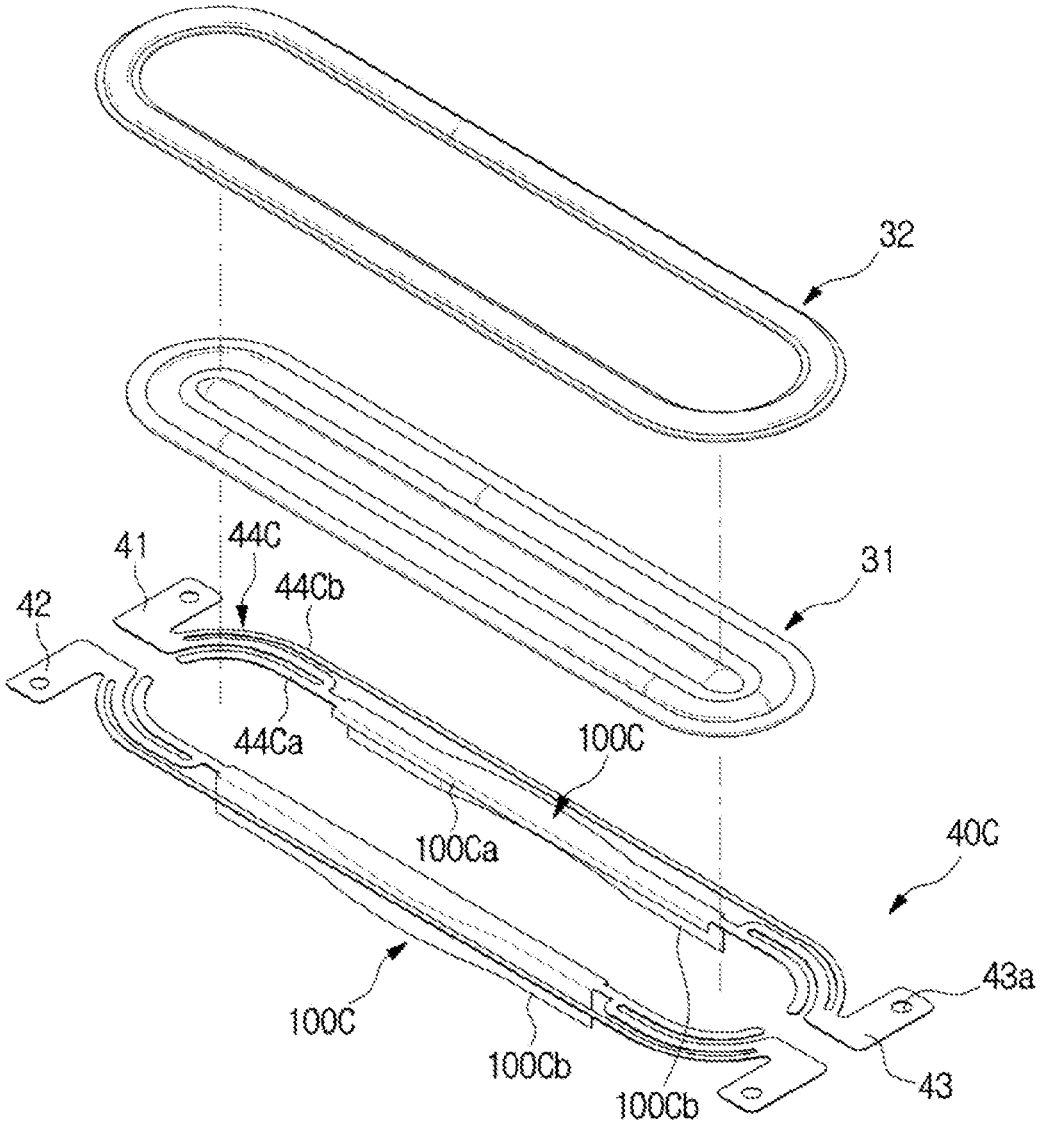
FIG. 13 is a perspective view of deformation prevention members according to an exemplary embodiment.
Figure 14:
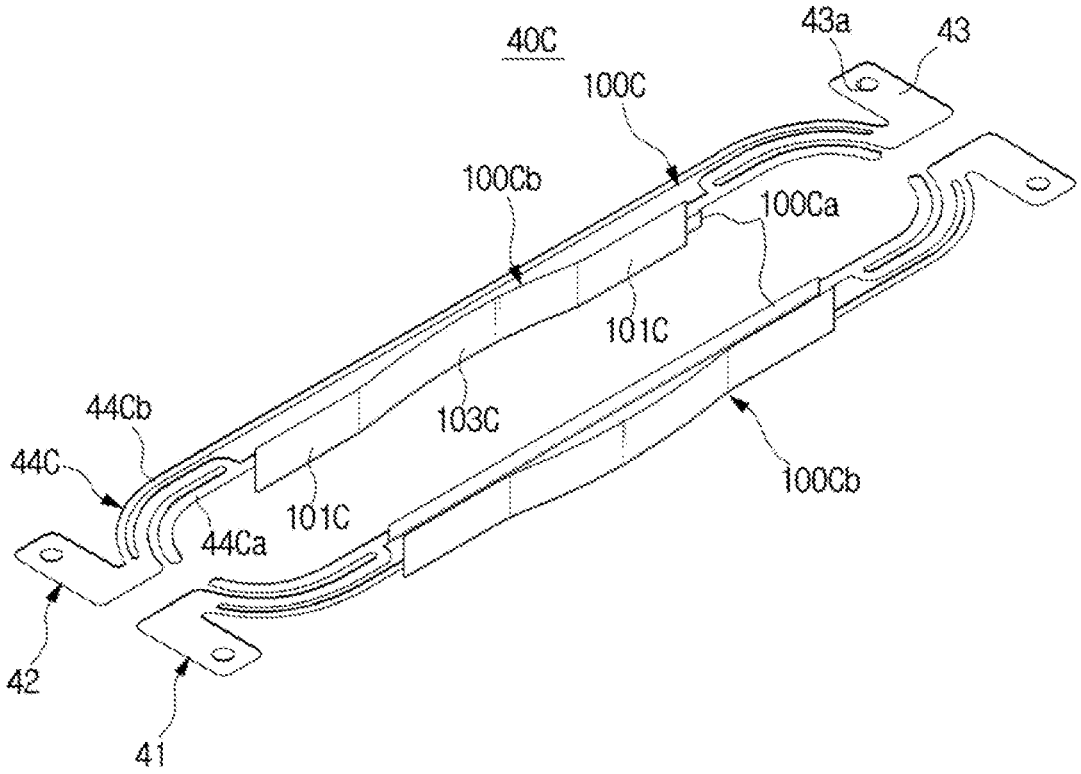
FIG. 14 is an enlarged perspective view of the deformation prevention members according to an exemplary embodiment.
Figure 15:
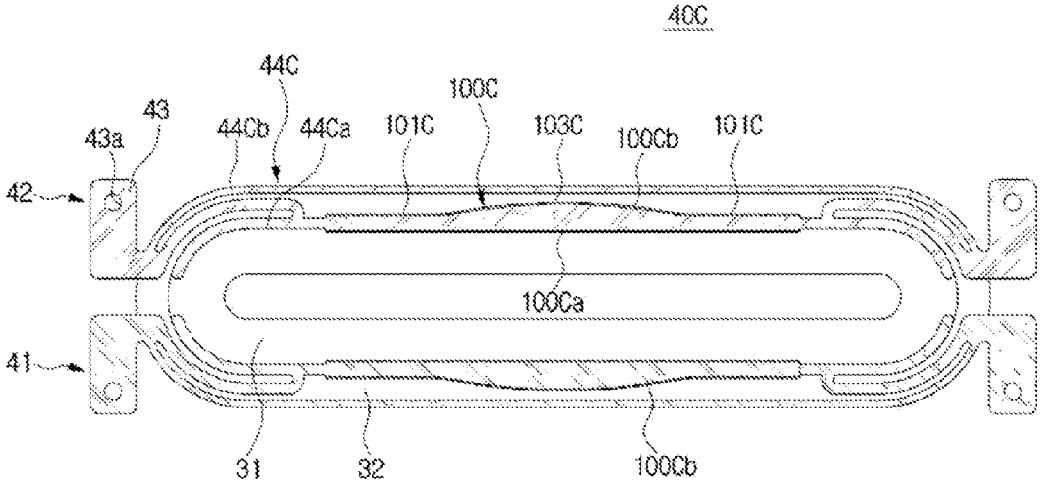
FIG. 15 is a view of coupling of the deformation prevention members according to an exemplary embodiment and a diaphragm.

FIG. 13 is a perspective view of deformation prevention members 100C according to an exemplary embodiment. FIG. 14 is an enlarged perspective view of the deformation prevention members 100C according to an exemplary embodiment. FIG. 15 is a view of coupling of the deformation prevention members 100C according to an exemplary embodiment and a diaphragm 31.

As illustrated in FIGS. 13 through 15, deformation prevention members 100C according to an exemplary embodiment are provided on a damper 40C.

The deformation prevention members 100C may be integrally formed with the damper 40C.

The damper 40C is formed from a pair of metal plates 41 and 42 disposed to be symmetrical with each other.

The damper 40C includes terminals 43 disposed on both ends of the damper 40C and a connection support fixture 44C that connects the terminals 43.

The connection support fixture 44C may include an inner support fixture 44Ca disposed to connect insides of the terminals 43 and an outer support fixture 44Cb disposed outside the inner support fixture 44Ca so as to connect outsides of the terminals 43. In the exemplary embodiment, the connection support fixture 44C includes the inner support fixture 44Ca and the outer support fixture 44Cb. However, the exemplary embodiment is not limited thereto. The connection support fixture 44C may be formed as one connection support fixture, an inside and an outside of which are integrally formed.

Meanwhile, the deformation prevention members 100C may be integrally formed with the connection support fixture 44C.

The deformation prevention members 100C may include a first deformation prevention member 100Ca formed to be bent from an inner end of the inner support fixture 44Ca downward and a second deformation prevention member 100Cb formed to be bend from an outer end of the inner support fixture 44Ca downward.

In the exemplary embodiment, each deformation prevention member 100C is provided on a bottom surface of the damper 40C so as to extend along a major-axis direction of the damper 40C.

The first deformation prevention member 100Ca may include straight panel portions 101C formed on both ends of the first deformation prevention member 100Ca and curve portions 103C formed between the straight panel portions 101C. The curve portions 103C may be formed so their protrusion portions may protrude from an outside of the damper 40C.

The second deformation prevention member 100Cb is formed in the shape of a straight panel from the center of the inner support fixture 44Ca along a major-axis direction of the inner support fixture 44Ca.

In the exemplary embodiment, the first deformation prevention member 100Ca and the second deformation prevention member 100Cb may be disposed parallel to each other.

Thus, outer edges of the diaphragm 31 are supported by the second deformation prevention member 100Cb of the damper 40C, and the center portion (i.e., an area between the inner edge and the outer edge) of the diaphragm 31 is supported by the first deformation prevention member 100Ca of the damper 40C.

In this case, the curve portions 103C of the deformation prevention member 100C more stably support the center portion of the diaphragm 31 so that the strength of the diaphragm 31 along the major-axis direction and the strength of the center portion of the diaphragm 31 can be reinforced and thus smooth vibration can be performed without any deformation of the long-axis direction portion.

Figure 16:
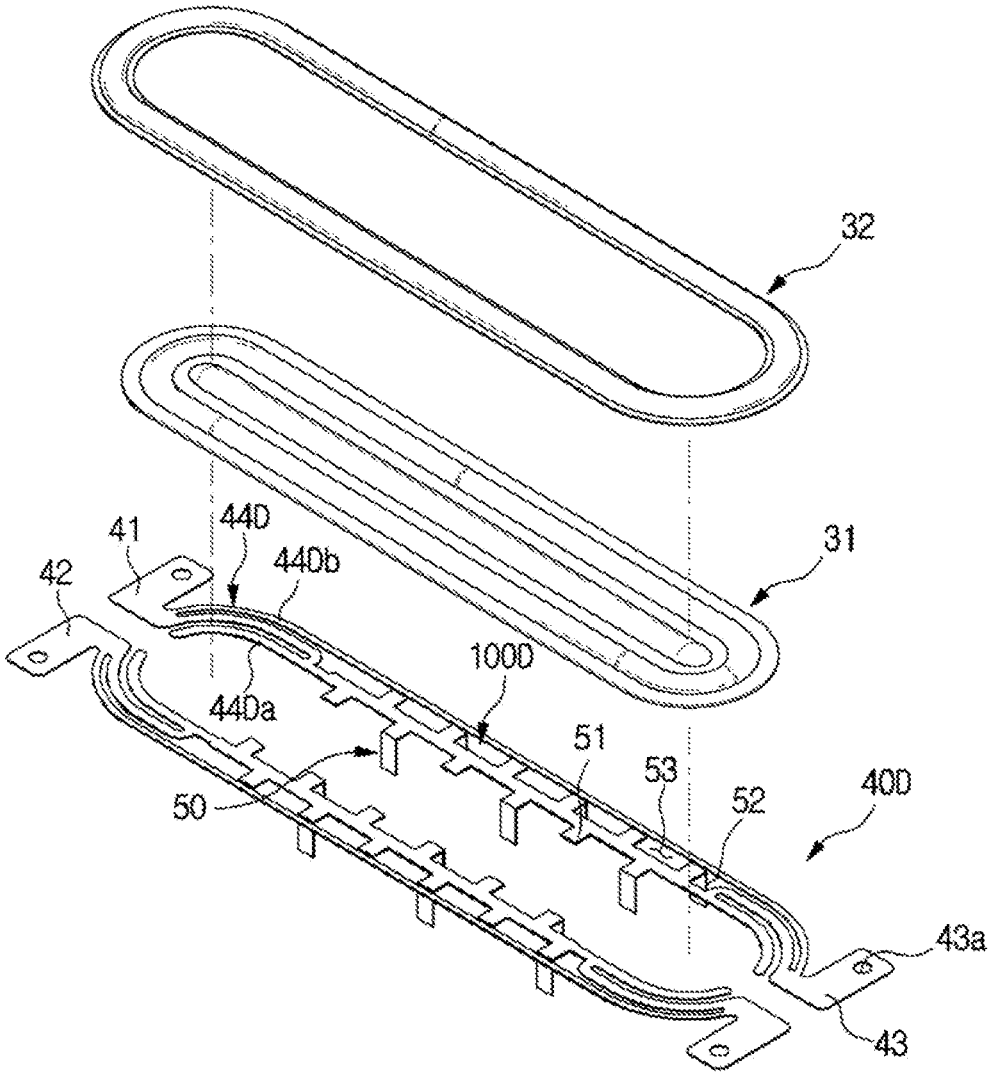
FIG. 16 is a perspective view of deformation prevention members according to an exemplary embodiment.
Figure 17:
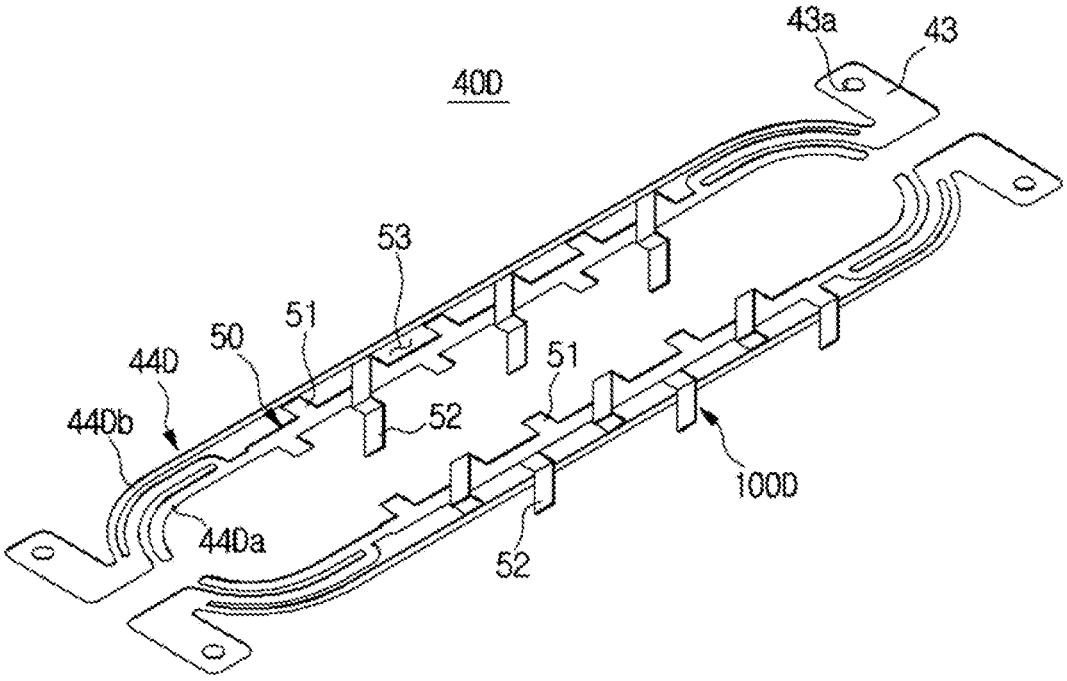
FIG. 17 is an enlarged perspective view of the deformation prevention members according to an exemplary embodiment.
Figure 18:
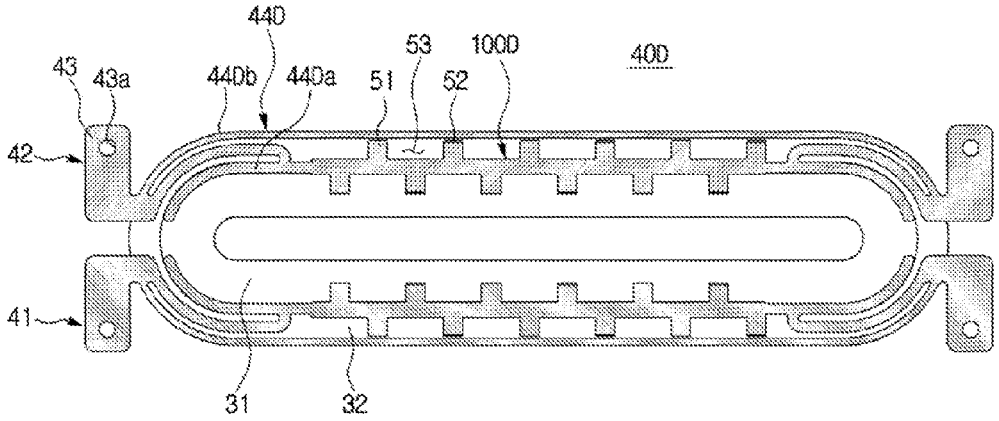
FIG. 18 is a view of coupling of the deformation prevention members according to an exemplary embodiment and a diaphragm.

FIG. 16 is a perspective view of deformation prevention members 100D according to an exemplary embodiment. FIG. 17 is an enlarged perspective view of the deformation prevention members 100D according to an exemplary embodiment. FIG. 18 is a view of coupling of the deformation prevention members 100D according to an exemplary embodiment and a diaphragm 31.

As illustrated in FIGS. 16 through 18, deformation prevention members 100D according to an exemplary embodiment are provided on a damper 40D.

The deformation prevention members 100D may include protrusions 50 that are integrally formed in the damper 40D.

The damper 40D includes a pair of metal plates 41 and 42 disposed to be symmetrical with each other.

Each of a first metal plate 41 and a second metal plate 42 includes terminals 43 disposed on both ends of each of the first metal plate 41 and the second metal plate 42 and a connection support fixture 44D that connects the terminals 43.

The connection support fixture 44D may include an inner support fixture 44Da disposed to connect insides of the terminals 43 and an outer support fixture 44Db disposed outside the inner support fixture 44Da so as to connect outsides of the terminals 43.

Meanwhile, the deformation prevention members 100D may be integrally formed with the inner support fixture 44Da of the connection support fixture 44D. In the exemplary embodiment, the deformation prevention members 100D are formed in the inner support fixture 44Da of the connection support fixture 44D. However, the exemplary embodiment is not limited thereto. For example, deformation prevention members may also be formed in an outer support fixture 44Db.

Each of the deformation prevention members 100D may include the protrusions 50 that extend from the center of the inner support fixture 44Da and are integrally formed.

The protrusions 50 may include a plurality of protrusion surfaces 51 that extend in both horizontal directions of the inner support fixture 44Da and protrusion pieces 52 formed to be bent from the plurality of protrusion surfaces 51.

The protrusion pieces 52 may be disposed perpendicular to ends of each of the protrusion surfaces 51 along the major-axis direction of the diaphragm 31.

The plurality of protrusion surfaces 51 may include separation portions 53 formed therebetween.

In the exemplary embodiment, the separation portions 53 may be uniformly formed at regular intervals or non-uniformly at irregular intervals.

Meanwhile, outer edges of the diaphragm 31 are supported by the outer support fixture 44Db of the damper 40D, and the center of the diaphragm 31 is supported by the deformation prevention members 100D of the damper 40D that extends in the long-axis direction of the diaphragm 31.

In the exemplary embodiment, various structures corresponding to various vibration characteristics of the diaphragm 31 may be applied to the protrusions 50 of the deformation prevention members 100D so that design efficiency caused by various structures can be improved.

As described above, according to the exemplary embodiments discussed above, a structural deformation can be prevented so that sound quality can be improved.

In addition, vertical movement of a diaphragm can be supported and simultaneously, rigidity can be reinforced.

Furthermore, deformation prevention members having various shapes can be applied so that improvements in performance of a speaker and design efficiency can be achieved.

While exemplary embodiments have been particularly shown and described above, it would be appreciated by those skilled in the art that various changes may be made therein without departing from the principles and spirit of the inventive concept defined in the following claims.

What is claimed is:

1. A speaker comprising:

a diaphragm; and a damper configured to adjust vibration of the diaphragm and comprising first and second metal plates that are symmetrical to each other with respect to a major-axis direction of the diaphragm, wherein the damper further comprises:

a first deformation prevention member bent downward at a first inner edge of the first metal plate; and a second deformation prevention member bent downward at a second inner edge of the second metal plate, wherein the first and second deformation prevention members extend along the major-axis direction of the diaphragm, and are configured to prevent deformation of the diaphragm, and wherein the first and second inner edges of the first and second metal plates extend along the major-axis direction.

2. The speaker of claim 1, wherein each of the first and second deformation prevention members comprises at least one straight panel disposed to be parallel to each other along the major-axis direction.

3. The speaker of claim 2, wherein each of the first and second deformation prevention members further comprises a curved panel connected to the at least one straight panel.

4. The speaker of claim 1, wherein each of the first and second deformation prevention members comprises:

a plurality of straight panels; and a curved panel, wherein the plurality of straight panels are disposed to be parallel to each other along the major-axis direction.

5. The speaker of claim 1, wherein each of the first and second deformation prevention members comprises:

a contact surface which comes into contact with a bottom surface of a corresponding one of the first and second metal plates; and a bending portion bent downward from the contact surface.

6. The speaker of claim 5, wherein the bending portion is formed in a panel shape.

7. The speaker of claim 6, wherein at least a part of the bending portion comprises a curved panel.

8. The speaker of claim 1, wherein the damper is formed integrally with the diaphragm.

9. The speaker of claim 1, wherein the damper is configured to prevent deformation of the diaphragm due to a vertical load in a center portion of the diaphragm along the major-axis direction.

10. A speaker comprising:

a diaphragm; and a damper configured to adjust vibration of the diaphragm and comprising a first metal plate and a second metal plate having polarities that are different from each other and symmetrical with each other, wherein the damper further comprises:

a first deformation prevention member bent downward at a first inner edge of the first metal plate; and a second deformation prevention member bent downward at a second inner edge of the second metal plate, wherein the first and second deformation prevention members extend along a major-axis direction of the diaphragm, and are configured to prevent deformation of the diaphragm caused by a vertical load, and wherein the first and second inner edges extend along the major-axis direction, wherein each of the first and second deformation prevention members comprises at least one protrusion which extends outward from opposite edges of a corresponding one of the first and second metal plates, and wherein the at least one protrusion comprises:

a plurality of protrusion surfaces which extend in a horizontal direction with respect to the first and second metal plates, each of the plurality of protrusion surfaces having at least one separation portion; and a plurality of protrusion pieces, each of plurality of protrusion pieces bent from a respective protrusion surface of the plurality of protrusion surfaces in a vertical direction with respect to the first and second metal plates.

11. A speaker comprising:

an oval-shaped diaphragm having a major axis and a minor axis; and a damper configured to adjust vibration of the oval-shaped diaphragm and having a first and second inner surfaces, wherein the damper comprises:

a first damper comprising a first deformation prevention member bent in a direction perpendicular to a direction of the major axis at a first inner edge of the first metal plate; and a second damper having a different polarity from the first damper and comprising a second deformation prevention member bent in a direction perpendicular to the direction of the major axis at a second inner edge of the second metal plate, the first and second inner edges of the first and the second metal plates extending in the direction of the major axis, wherein the first damper and the second damper are symmetrical with each other with respect to the major axis, and wherein the first and second deformation members are configured to prevent deformation in the direction of major axis of the oval-shaped diaphragm.

12. The speaker of claim 11, wherein each of the first and second deformation prevention members comprises a plurality of panels disposed to be parallel with one another in a major-axis direction.

13. The speaker of claim 12, wherein each of the first and second deformation prevention members further comprises a curved panel protruding from the plurality of panels.

14. The speaker of claim 11, wherein the damper has a plate shape, is made with a metal material.

15. The speaker of claim 14, wherein the first and second deformation prevention members are disposed in corresponding positions of the first damper and the second damper, respectively, to be parallel to each other.

16. The speaker of claim 14, wherein the first and second deformation prevention members are bent downward from an inner end of each of the first damper and the second damper, respectively, and are integrally formed with the first and second dampers, respectively.

17. A speaker comprising:

an oval-shaped diaphragm having a major axis and a minor axis; and a damper configured to adjust vibration of the oval-shaped diaphragm and having a first and second inner surfaces, wherein the damper comprises:

a first deformation prevention member bent in a direction perpendicular to a direction of the major axis at a first inner edge of the first metal plate; and a second deformation prevention member bent in a direction perpendicular to the direction of the major axis at a second inner edge of the second metal plate, the first and second inner edges of the first and the second metal plates extending in the direction of the major axis, wherein the first and second deformation members are configured to prevent deformation in the direction of the major axis of the oval-shaped diaphragm, and wherein each of the first and second deformation prevention members further comprises a plurality of protrusions, each of the plurality of protrusions having at least one separation portion.

18. The speaker of claim 17 wherein each of the plurality of protrusions comprises:

a protrusion surface which extends in a horizontal direction with respect to the damper; and a protrusion piece bent from the protrusion surface in a vertical direction with respect to the damper.

19. A speaker comprising:

a rectangular frame having a long axis and a short axis;

a magnetic circuit unit coupled to the frame and configured to generate a magnetic force;

a voice coil provided in the frame to vibrate due to the magnetic force;

a diaphragm configured to vibrate and produce sound due to vibration of the voice coil; and a damper provided between the diaphragm and the voice coil and configured to adjust vibration of the diaphragm, wherein the damper has a plate shape, and comprises:

a first damper;

a second damper having a different polarity from the first damper; and a first and second deformation prevention members provided on the first damper and the second damper, respectively, and extending along a long-axis direction of the diaphragm, the first and second deformation prevention members being configured to prevent a deformation of the diaphragm caused by a vertical load, wherein the first damper and the second damper are symmetrical with each other with respect to the long axis, wherein the first deformation prevention member is bent downward at a first inner edge of the first damper and the second deformation prevention member is bent downward at a second inner edge of the second damper, and wherein the first and second inner edges of the first and second dampers extend along the long-axis direction.

20. The speaker of claim 19, wherein the first and second deformation prevention members are integrally formed with the first and second dampers, respectively.

21. The speaker of claim 19, wherein each of the first and second deformation prevention members comprises at least one straight panel, and wherein the first and second deformation prevention members are disposed in corresponding positions of the first damper and the second damper, respectively, to be parallel to each other.

22. The speaker of claim 21, wherein each of the first and second deformation prevention members further comprises a curved panel.

23. A speaker comprising:

a rectangular frame having a long axis and a short axis;

a magnetic circuit unit coupled to the frame and configured to generate a magnetic force;

a voice coil provided in the frame to vibrate due to the magnetic force;

a diaphragm configured to vibrate and produce sound due to vibration of the voice coil; and a damper provided between the diaphragm and the voice coil and configured to adjust vibration of the diaphragm, wherein the damper has a plate shape, and comprises:

a first damper;

a second damper having a different polarity from the first damper; and a first and second deformation prevention members provided on the first damper and the second damper, respectively, and extending along a long-axis direction of the diaphragm, the first and second deformation prevention members being configured to prevent a deformation of the diaphragm caused by a vertical load, wherein the first deformation prevention member is bent downward at an inner edge of the first damper and the second deformation prevention member is bent downward at an inner edge of the second damper, wherein the inner edges of the first and second dampers extend along the long-axis direction, and wherein each of the first and second deformation prevention members comprises a plurality of protrusions, each of the plurality of protrusions having at least one separation portion.

24. The speaker of claim 23, wherein each of the plurality of protrusions comprises:

a protrusion surface which extends in a horizontal direction with respect to the damper; and a protrusion piece bent from the protrusion surface in a vertical direction with respect to the damper.

25. A vibration unit of a speaker comprising:

a diaphragm configured to produced sound; and a damper provided under the diaphragm to support the diaphragm and configured to adjust vibration of the diaphragm, wherein the damper comprises:

a first and second connection fixtures extending along a major axis of the diaphragm and extending on a surface including the major axis and a minor axis; and a first and second deformation prevention members bent downward from the first and second connection fixtures, respectively, in a direction intersecting the major and minor axes along an inner edge of the first and second connection fixtures, respectively, wherein the first and second connection fixtures are symmetrical with each other with respect to the major axis, wherein the first and second deformation prevention members extend along the major axis of the diaphragm, and wherein the inner edges of the first and second connection fixtures extend along a direction of the major axis.

26. The speaker of claim 25, wherein each of the first and second deformation prevention members comprises a straight panel.

27. The speaker of claim 25, wherein each of the first and second deformation prevention members further comprises a curved panel.

* * * * *